United States Patent [19]

Apanovitch

[11] 4,212,282

[45] Jul. 15, 1980

[54] POSITIVE DISPLACEMENT, CONTINUOUS COMBUSTION ROTARY ENGINE

[76] Inventor: Agaton P. Apanovitch, 1060 Poquonock Ave., Windsor, Conn. 06095

[21] Appl. No.: 943,701

[22] Filed: Sep. 19, 1978

[51] Int. Cl.[3] ..... F01C 1/00; F02B 53/00

[52] U.S. Cl. ..... 123/204; 123/235; 123/237; 418/231

[58] Field of Search ..... 60/39.34, 39.35; 123/204, 235, 237; 418/228, 229, 230, 231, 232

[56] References Cited

U.S. PATENT DOCUMENTS

| | | | |
|---|---|---|---|
| 516,503 | 3/1894 | Meyer | 418/231 X |
| 651,838 | 6/1900 | Eastburgh | 418/231 X |
| 880,333 | 2/1908 | Seibert | 418/232 |
| 3,791,139 | 2/1974 | Simons | 60/39.34 |
| 3,876,350 | 4/1975 | Warder | 418/231 X |
| 3,989,011 | 11/1976 | Takahashi | 123/204 |

*Primary Examiner*—Michael Koczo
*Attorney, Agent, or Firm*—Charles A. Warren

[57] ABSTRACT

A rotary pump or motor has a rotor with no relatively movable parts and has the valving incorporated in the housing with the valving actuated by cams on the rotor. The air or gas flow through the pump or motor is by way of passages in the rotor on opposite sides of a piston on the rotor, this piston fitting in an annular groove in the housing.

This type of pump or motor device is utilized in a hot gas engine in which two or more devices functioning as pumps in series supply compressed air to a burner and two or more similar devices functioning as motors receive hot gas under pressure from the burner to be driven by this gas and in turn driving the pumps for operation as a hot gas engine. The rotors of all the pumps and motors are incorporated in a single rotor with a burner construction also in the rotor between the pump rotor elements and the motor rotor elements.

21 Claims, 15 Drawing Figures

POSITIVE DISPLACEMENT, CONTINUOUS COMBUSTION ROTARY ENGINE

BACKGROUND OF THE INVENTION

In rotary pumps or motors, it is usual to incorporate moving vanes, which have an axial or radial movement as the rotor turns to control the flow of fluid within the device and thereby obtain the pump or motor action. Movable parts in the rotor add complexities in the mechanism for actuating these parts and may result in failure because of the centrifugal load on these parts.

Hot gas engines presently in use are frequently of the gas turbine type and these have a narrow speed range for best performance. They are generally also high speed devices thus requiring extensive reduction gearing for driving low speed devices. A gas engine utilizing a rotary pump for a compressor and a similar rotary motor as the drive for the compressor and to produce additional energy for use has been a complex device and accordingly difficult to manufacture, service and overhaul. Simplified rotary pump/motors of matching capacity could produce a simplified gas engine that would have a wide speed range and could be easily assembled and disassembled.

SUMMARY OF THE INVENTION

One feature of the invention is a rotary pump/motor having a simplified rotor with no relatively movable parts that require external actuation. Another feature is a pump/motor in which the piston is on the rotor and the valving for the control of the fluid being pumped or of the motor fluid is mounted in the casing, thereby making actuation simpler. Another feature is sliding plate type valves in the housing with the inlet and discharge passages positioned on the rotor on opposite sides circumferentially of the piston and with the valve actuated to align passages therein with the piston to permit movement of the piston past the valve as the rotor turns.

A particular feature of the invention is the incorporation of this form of pump/motor in a gas engine in which at least two devices acting as pumps serve to supply air continuously under constant pressure to a burner for continuous flow fuel combustion, and at least two similar devices acting as motors are driven by hot gas from the burner and in turn drive the pumps and provide additional power for external use. The constant pressure, continuous flow fuel combustion feature allows the use of low-cost, low-octane fuel. Also the combustion process can be controlled to produce negligible amounts of exhaust gas pollutants mainly because of the excess combustion air and lower peak combustion temperatures. Another feature is the incorporation of the burner within the rotor of the engine.

According to the invention, the rotor carries at least one peripherally located piston moving in an annular path in the surrounding housing. At all times at least one valve, positioned in the housing closes this path at one point to permit continuous pumping or motor action as the piston approaches and moves away from the valve during operation of the device. The flow paths for the fluid into the annular passage are located in the rotor and communicating with the periphery of the rotor on opposite sides of the piston. The valve is actuated to provide a passage for the piston past the valve by cams on the rotor. Preferably these cams have direct connection to the valve free of links and levers.

Further in accordance with the invention, a hot gas engine has two or more of these pump devices serving as air compressors delivering air to a burner and with two or more of these devices acting as motors driven by the hot gas from the burner connected to the pumps for driving them and for providing additional power for external use. The rotors of the several pumps and motors are combined into a single engine rotor with the gas flow passages all within the rotor and with the burner structure also within the rotor.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figure 1:
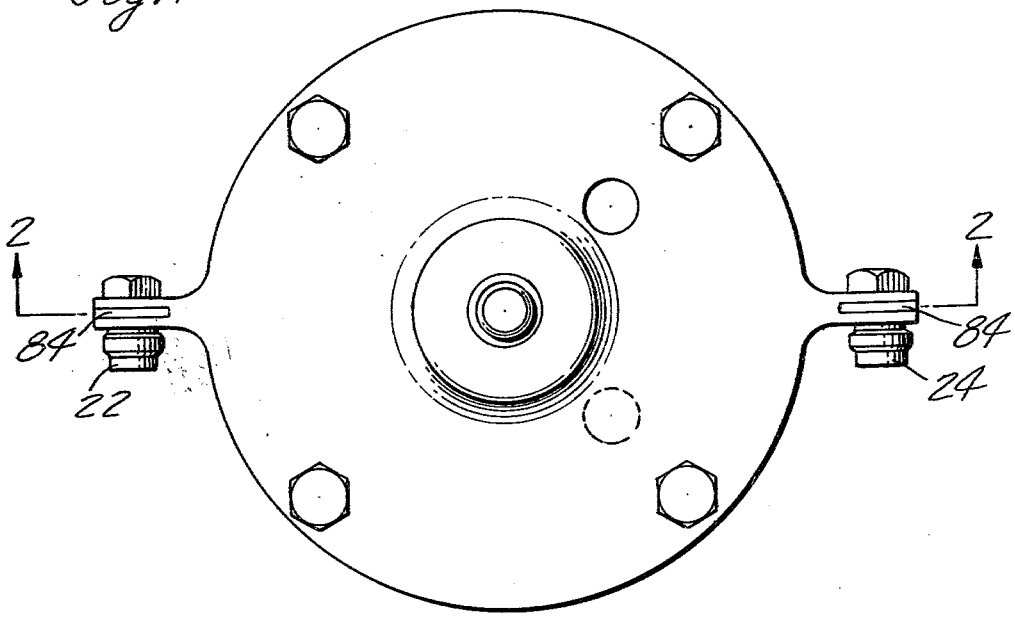
FIG. 1 is an end view of the pump/motor.
Figure 2:
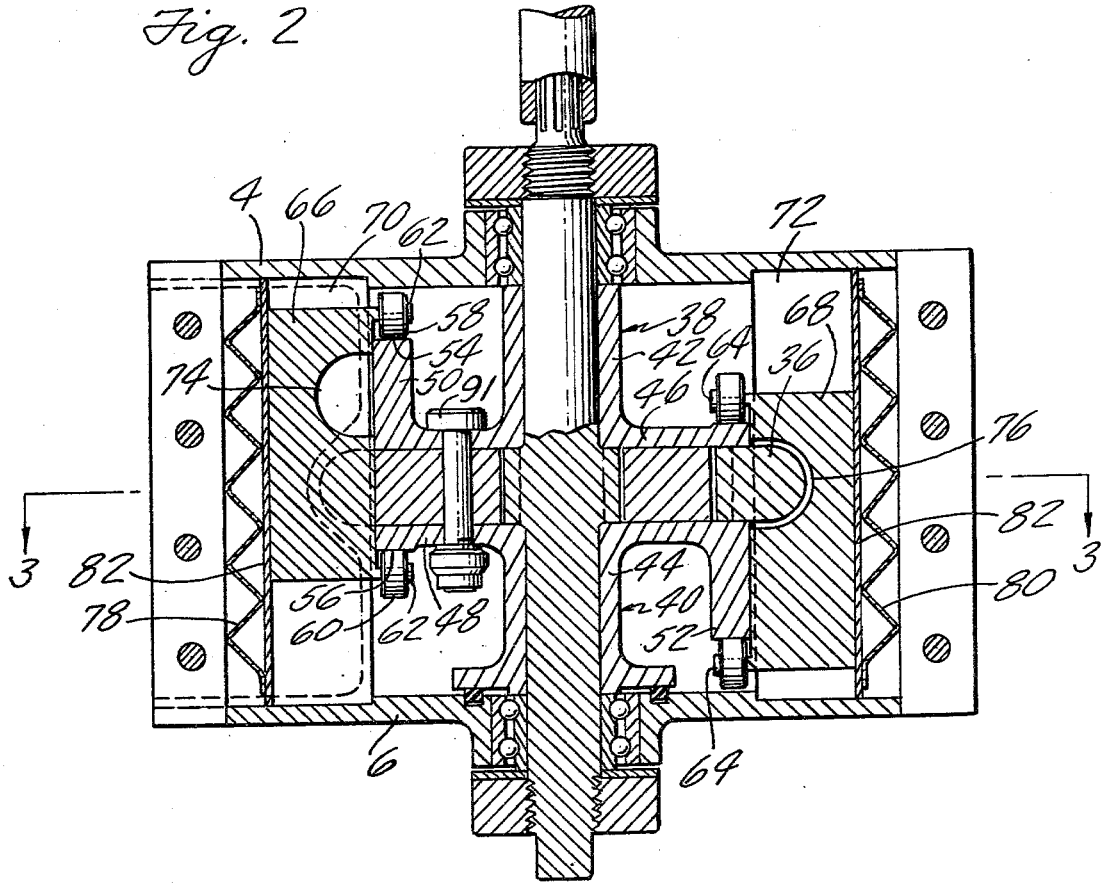
FIG. 2 is a sectional view along line 2—2 of FIG. 1.
Figure 3:
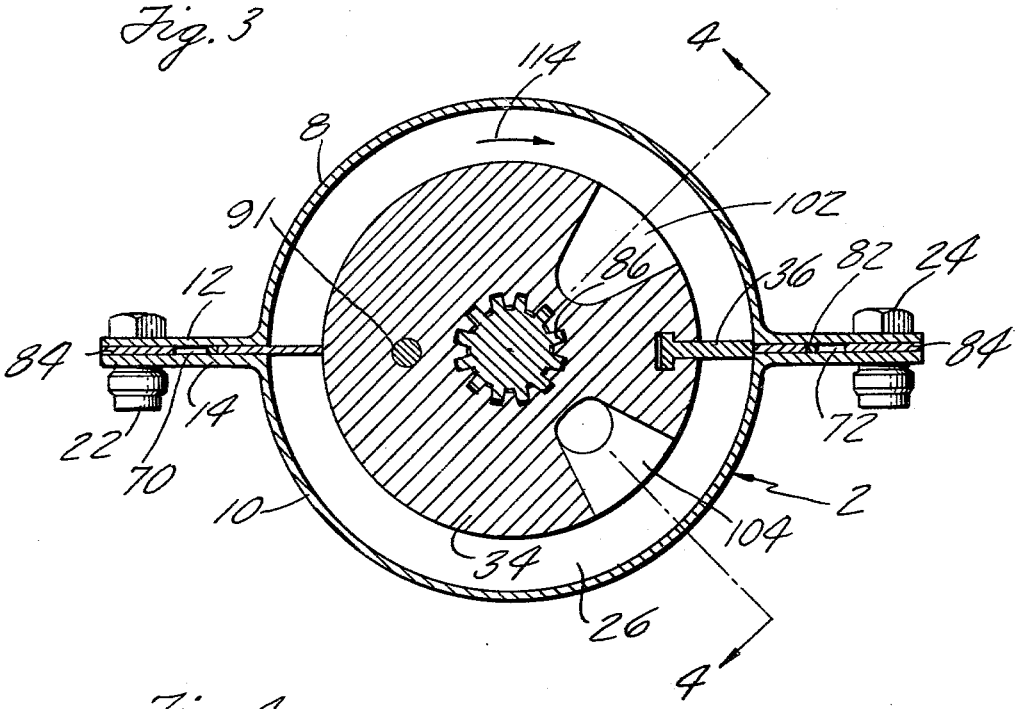
FIG. 3 is a sectional view along line 3—3 of FIG. 2.

Referring first to FIGS. 1–4, the pump/motor has a housing 2 including inlet and discharge end caps 4 and 6 and a split cylindrical casing of semi-cylindrical elements 8 and 10, FIG. 3, carrying axial extending bolting flanges 12 and 14, respectively, at opposite edges. These elements 8 and 10 also carry end flanges 16 and 18 by which the end caps are secured to the casing. Suitable bolts 20 hold the end caps in position and bolts 22 and 24 secure the opposed axial flanges in position. The elements 8 and 10 have a central annular projection 25 thereon between the ends to form on the inner side of the casing an annular groove 26 which becomes the annular gas path surrounding the rotor 27.

This rotor includes an axial shaft 28 supported in bearings 30 and 32 in end caps 4 and 6, respectively. Centrally located on the shaft is a disc 34, the periphery of which carries a piston or vane 36 shaped to fit in the annular groove 26. On opposite sides of the disc 34 are rings 38 and 40 each consisting of a sleeve 42 and 44, respectively, fitting on the shaft, a radial disc or flange 46 and 48 extending outwardly therefrom and contacting opposite sides of the disc, and an axial projection 50 and 52 lying just inside the outer casing. Those projections have cam surfaces 54 and 56, respectively, thereon to engage with rollers 58 and 60, FIG. 2, carried by inwardly extending pins 62 and 64 on slidable plates or valves 66 and 68 in grooves 70 and 72 between the opposed flanges 12 and 14 on the casing.

These valves are moved axially in the grooves by the cams so as to seal the annular gas path except for the part of each rotation when the piston 36 passes through openings 74 and 76 in the valves, respectively. Suitable springs 78 and 80 urge the valves radially against the rotor. A floating spacer 82 may be positioned between each spring and the adjacent valves to close the respective grooves at the outer edges of the valves. The grooves 70 and 72 may be formed by spacers 84 between the flanges 12 and 14 at their outer edges where the bolts 22 and 24 are located.

The disc 34 is splined to the shaft as shown at 86 and the spline on the shaft, larger in diameter than the shaft, serves to locate the rings 38 and 40 axially on the shaft. The rotor is clamped together to turn as a unit by nuts 88 at opposite ends of the shaft, these nuts engaging the inner rings 90 of the bearings and holding them against the rings. A bolt 91 extending through disc 34 and rings 38 and 40 transmits torque among these elements to prevent relative rotation. One end of the shaft has a spline 92 for engagement by a drive connection 94 by which the rotor is driven when the device acts as a pump and by which power output from the rotor is delivered when the device functions as a motor.

The end cap 4 has an inlet opening 96 to an inlet chamber 98 within the casing. From this chamber fluid enters a passage 100 in the ring 38 and a curved passage 102 in the disc 34 that extends to the periphery of the disc and communicates with the annular fluid path 26. The disc has a similar outlet or exit passage 104 that leads through an opening 106 in the ring 40 to an outlet chamber 108. An outlet opening 110 in end cap 6 permits the discharge of fluid from the chamber 108. The rings 38 and 40 may be secured against rotation with respect to disc 34 as by one or more axial bolts 91 through the rotor as shown in FIG. 2.

Figure 4:
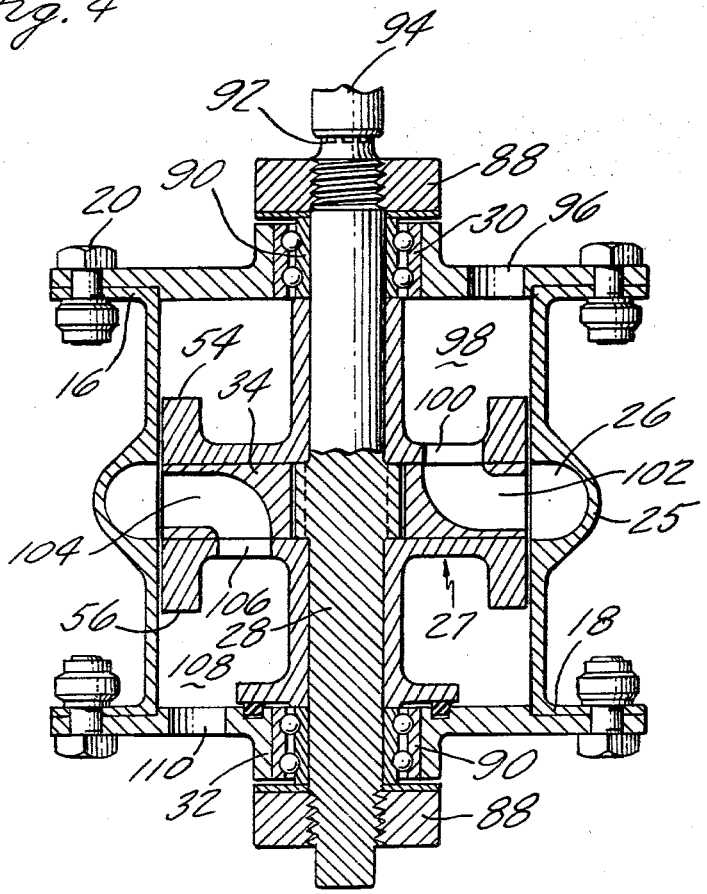
FIG. 4 is a sectional view along line 4—4 of FIG. 3.

The inlet and outlet passages 102 and 104, FIGS. 3 and 4, are located adjacent to one another as shown in FIG. 3 and on opposite sides of the vane or piston 36, the inlet passage being behind or in back of the piston with reference to the direction of rotation and the outlet passage 104 is forward of the piston. As above stated, the valves 66 and 68 are moved by the cams on the rotor so that when the piston is close to the valve, the latter is moved to align the opening 74 or 76 therein with the piston so the latter may pass the valve.

Figure 5:
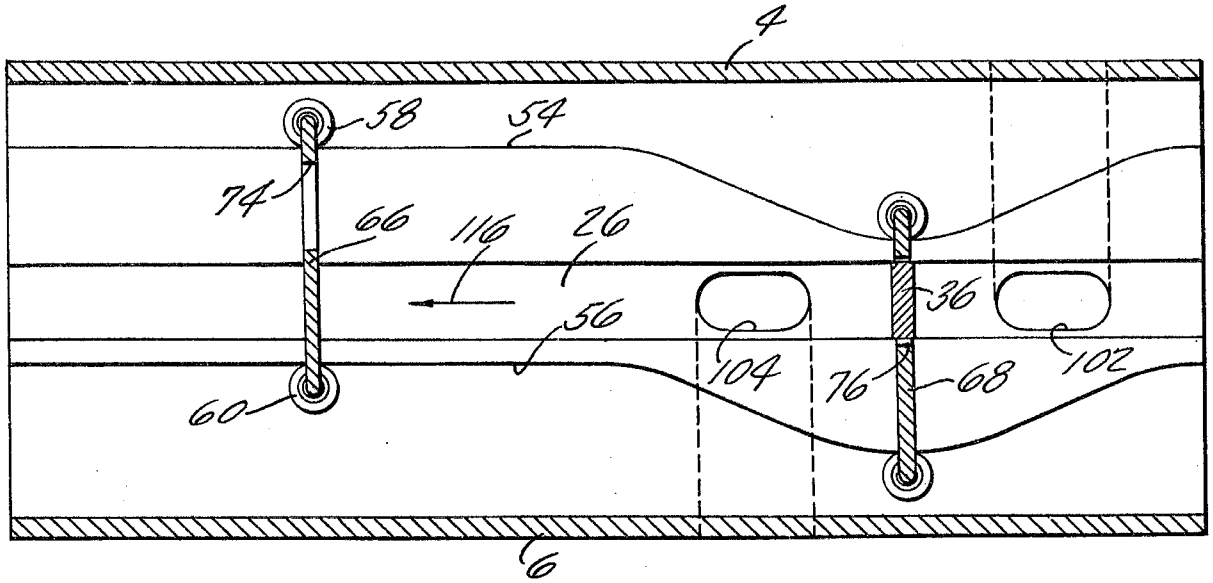
FIG. 5 is a developed view through the fluid annulus showing the functioning of the pump or motor as the piston passes the valve.
Figure 6:
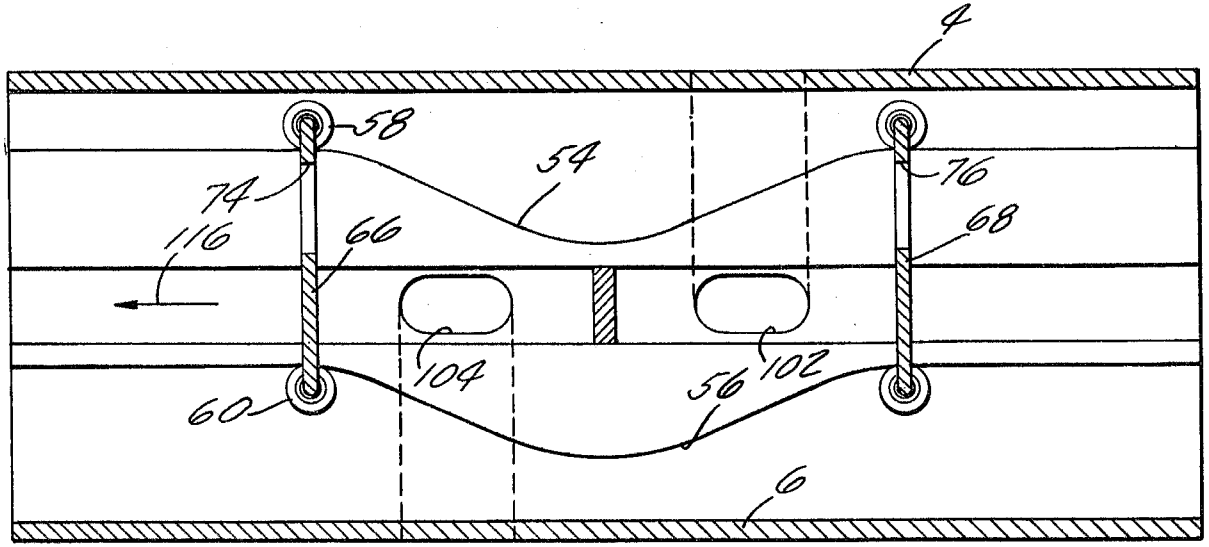
FIG. 6 is a view similar to FIG. 5 showing the rotor inlet and discharge in a different position and with the piston between the valves.
Figure 7:
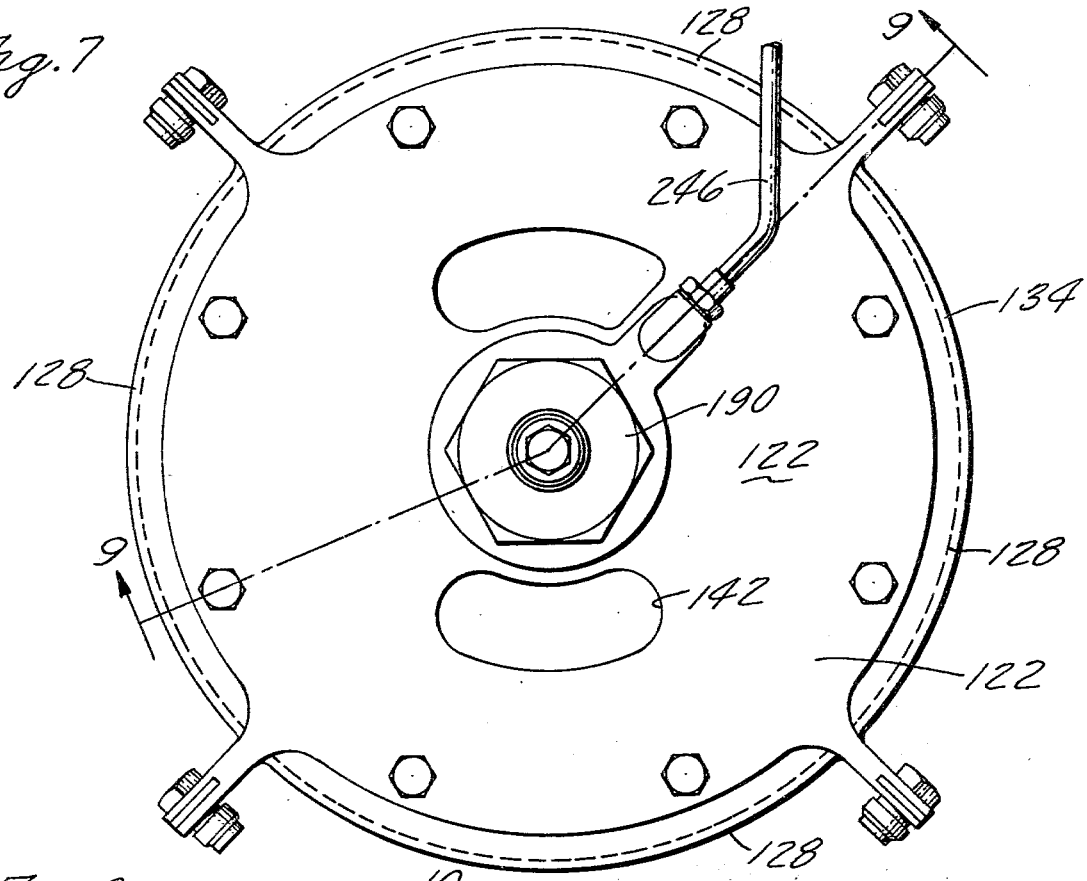
FIG. 7 is an inlet end view of an engine utilizing the pump or motor concept.
Figure 8:
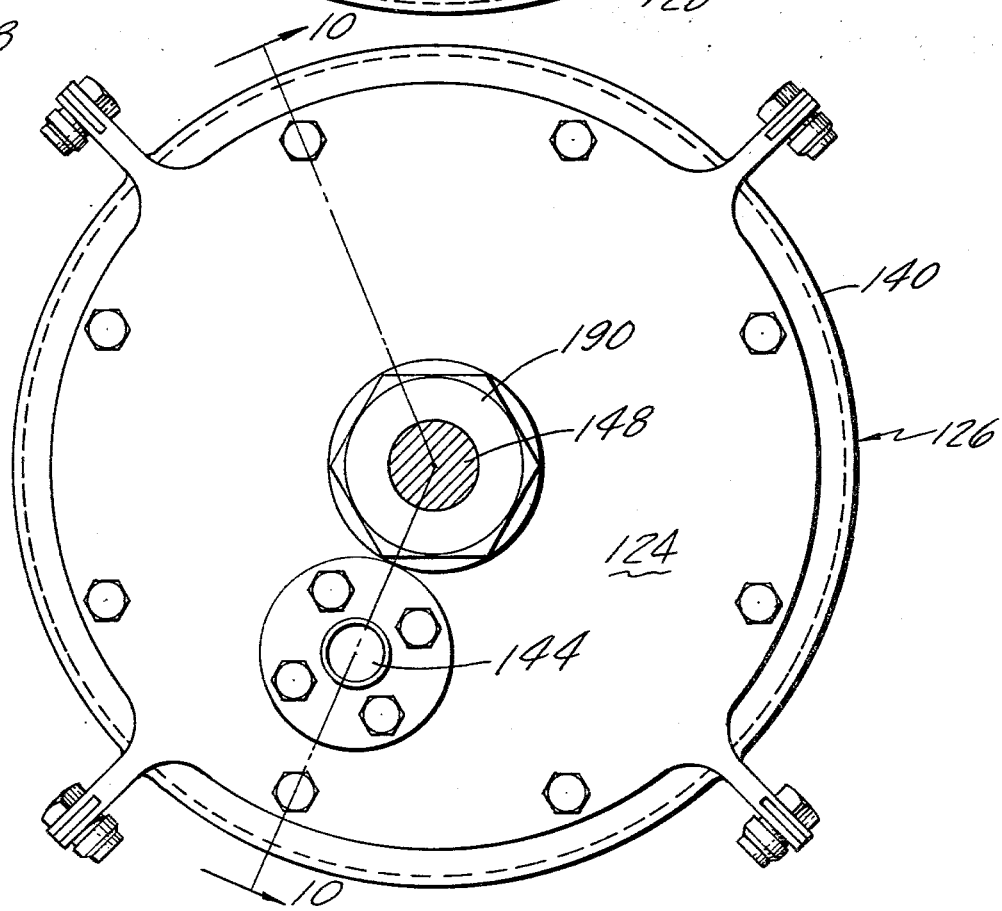
FIG. 8 is an exhaust end view of the engine of FIG. 7.

The operation of this device is believed to be clear from the preceding description. As the rotor turns in the direction of the arrow 114, FIG. 3, or moves in the direction of the arrow 116 in the developed views of FIGS. 5 and 6, fluid, normally a gas although not necessarily so, is put under pressure in the space between the piston and the valve and this pressure forces the fluid out the outlet passage 104 into chamber 108 and thence through the opening 110 to be suitably collected under pressure as in a tank, not shown. When the piston 36 is close to either valve 66 or 68, this valve is moved by the cam to open position (the right-hand side of FIG. 2), so that the piston passes therethrough and the valve is then moved back to closed position (the left-hand side of FIG. 2) and movement of the piston away from the valve creates a suction that draws fluid from the chamber 98 through passages 102 in the rotor and into the position of the annular fluid space 26 created in back of the piston. This procedure occurs twice for each revolution because of the two valves provided.

The above description is of the device operating as a pump when the fluid is being taken into the device through the inlet opening 96 at a low pressure and discharged through the outlet at a higher pressure through the outlet 110. At this time, power must be applied to the unit through the drive connection 94 to accomplish the pumping action.

The device may be operated as a motor by supplying fluid to the inlet 96 at a higher pressure than that at the outlet 110. When operated this way power may be delivered from the motor to the drive connection 94. When operating as a motor, fluid under pressure from inlet 96 flows through chamber 98 and rotor passage 102 into the space behind the piston 36. Fluid in this space, between the piston and the next valve exerts pressure on the piston to move it in the direction of the arrows. At the same time the space forward of the piston connects with the outlet through outlet passage 104 and fluid therein discharges at a lower discharge pressure. Obviously the valves are moved sequentially to allow the piston to move past the valves. This is a continuous pumping action with the fluid in front of the piston being pressurized between the piston and the next valve and discharging through the outlet passage, and fluid being drawn into the space in back of the piston through the inlet passage 96.

With the construction described, should it be desired to pump fluid in the opposite direction, the device will, upon reversal of the direction of rotation of the rotor, draw fluid in through passage 104 in the rotor and discharge it through passage 102 without any change in the structure or valve actuation.

The above described device may be used in a hot air engine in which two or more devices functioning as pumps deliver compressed air to a burner in which energy is added by combustion of fuel in the air and this high energy gas is then discharged through two or more of the devices operating as motors. Power developed in the motor devices drives the compressors and excess power is available for external power uses. An arrangement to accomplish this is shown in FIGS. 7 to 14 inclusive where the compressor shown uses two pumps in succession and the driving motor shown is also in two stages.

Referring to these figures, the engine has end caps 122 and 124 at inlet and discharge ends, respectively. These caps are connected by a generally cylindrical casing 126 made up of four arcuate sectors 128 having axial flanges 130 at opposite edges for attachment of the several sectors together to form the cylinder and with outwardly extending end flanges 132 for attachment of the end caps. The cylindrical casing has several integral annular rings formed in the periphery to define annular paths for gas therein. There are two rings 134 and 136 for the low pressure and high pressure pump devices and two other rings 138 and 140 for the high pressure and low pressure motor devices.

The casing being in separable 90 degree sectors facilitates assembly and permits disassembly in part for inspection of the parts within the casing. The inlet cap has an opening 142 for fluid, usually air, to enter the engine and the discharge cap has an opening 144 for the discharge of gas from the motor devices.

The rotor 146, enclosed in the housing, includes a shaft 148 journaled in bearings 150 in the end caps and having a spline 152 on a projecting end for takeoff of excess power delivered by the engine. Mounted on the shaft is a central drum 154 keyed as at 155 to the shaft and having axial passages 156 therethrough for the flow of fluid from the compressors or pumps to the motors. These passages serve as combustion chambers and have perforated sleeves or cans 158 therein that form combustion spaces within the chambers. The drum is preferably mounted on an enlarged central portion 160 of the shaft, this portion defining shoulders 162 at each end with which discs 164 and 166 engage as well as with opposite ends of the drum. Disc 164 is the high pressure compressor or pump disc in axial alignment with the ring 136 in the casing. Beside the disc 164 is a spacer 168 through which fluid is guided from the low to the high pressure pump. Against spacer 168 is the low pressure disc 170 in line with the annular ring 134. Upstream of the disc 170 is a plate 172 having an axially facing cam surface 174 at its periphery.

Downstream of and engaging the end of the drum, the motor disc 166 is in axial alignment with casing ring 138, and against this disc and mounted on the shaft is a spacer 176 through which fluid is guided from motor disc 166 to the low pressure motor disc 178 in axial alignment with the annular ring 140. Against the side of disc 178 is a ring 180 that includes a sleeve 182 on the shaft, a plate 184 engaging the disc 178 and an outer axial-facing cam surface 186 adjacent the casing surface. Also on the ring 180 is annular projection 188 having an axial passage 189 that directs fluid from motor disc 178 to the discharge opening 144. This assemblage of parts as above described is clamped on the shaft by nuts 190 at each end, these nuts clamping through the inner race 192 of the bearing and a seal spacer 191 against the plate 172 at the inlet end and through the inner race 193 and the sleeve 182 at the other end. Axial bolts 195 through the rotor transmit torque and prevent rotation between the several elements of the rotor. The drum 154 has a peripheral groove 194 between its ends and the end faces of the groove are cam surfaces 196 and 198 to cooperate with cam surfaces 174 and 186, respectively.

Each of the pump discs carries a pair of diametrically opposite vanes or pistons 200 on the low pressure pump and pistons 202 on the high pressure pump. Between each adjacent pair of casing sectors are positioned axially sliding valves 204, FIG. 9, to control the pumping action. These valves are slidable in grooves 206, FIGS. 11 and 12, created by spacers 208 between opposing flanges 130 on the casing in the bolting area. Springs 210, FIG. 9, hold the valves radially in engagement with the periphery of the rotor, a spacer 211 being positioned between the spring and the valve. Each vane has mating openings 212 and 214 to open or close the fluid path in the annular rings 134 and 136, respectively, to permit the pistons to pass these valves during operation of the engine. These valves have inwardly extending rollers 216 at opposite ends engaging with the cams 174 and 196 on the rotor.

At the motor end of the rotor, the disc 166 and 178 carry vanes or pistons diametrically opposed to each other, the disc 166 having pistons 218 fitting in the fluid path in the annular ring 138 and the disc 178 having pistons 220 fitting in the fluid path of the annular ring 140. These pistons are mounted in the periphery of the discs, as shown. Between each adjacent pair of axial flanges on the casing sectors are valves 222 to control the driving action of the fluid in these motors. These valves slide in the same grooves 206 as for the valves 204. Springs, which may be extensions of springs 210, hold these valves against the rotor through the spacers 211. Each vane has mating openings 228 and 230 to open and close the fluid path in the annular rings 138 and 140, respectively. Each vane has inwardly extending rollers 232 at their inner edges to engage with cams 198 and 186, respectively, for actuating the valve.

Air enters the engine through the openings 142 and is drawn into the fluid passage in annular ring 134 by the action of the piston as it moves away from each of the valves in succession. The disc 170 has two passages 234 therein receiving air through openings 236 in the plate 172 and guiding the air outwardly within the disc to its periphery and into the fluid path in ring 134.

Figure 10:
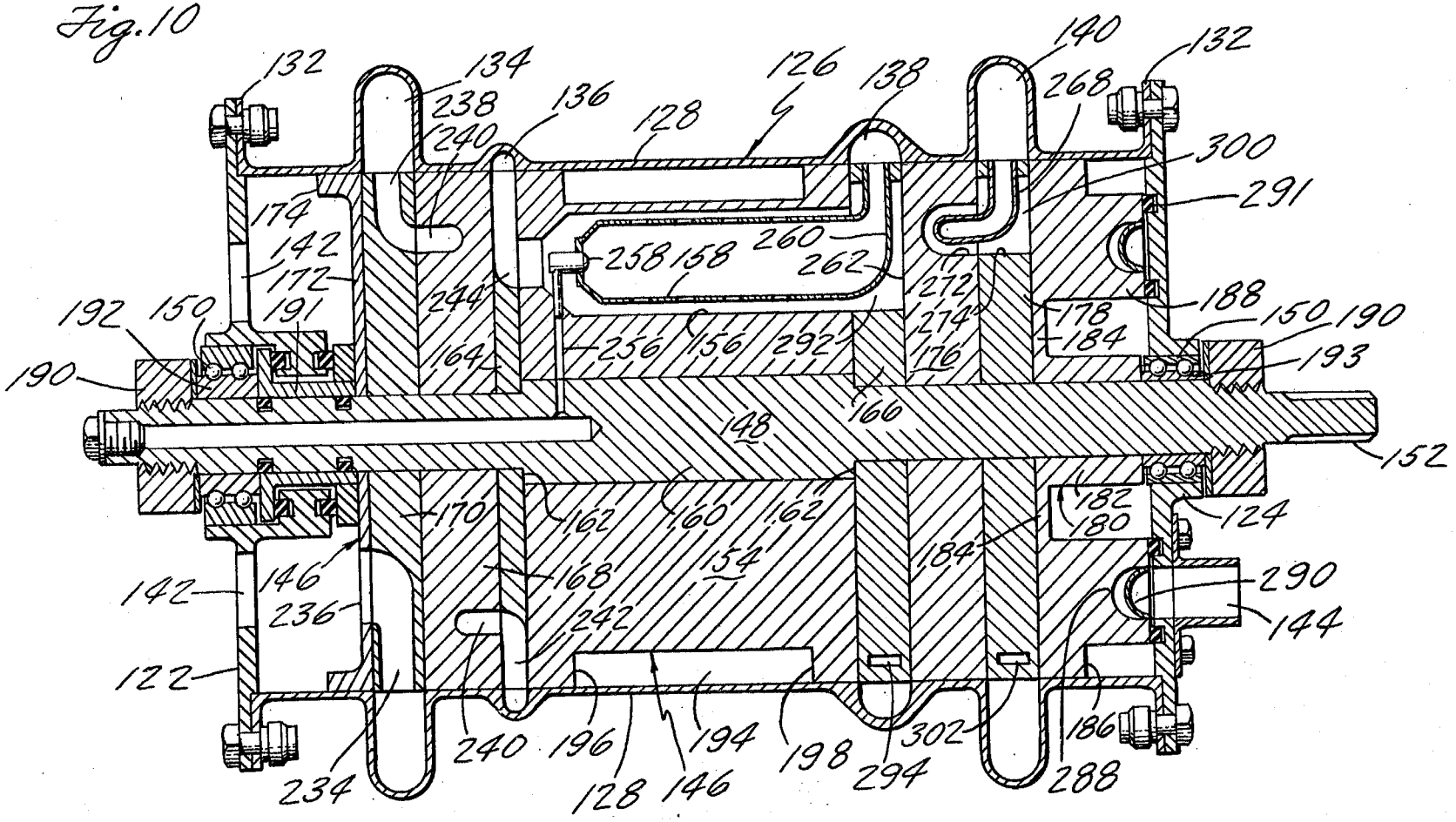
FIG. 10 is a sectional view along the line 10—10 of FIG. 8.
Figure 11:
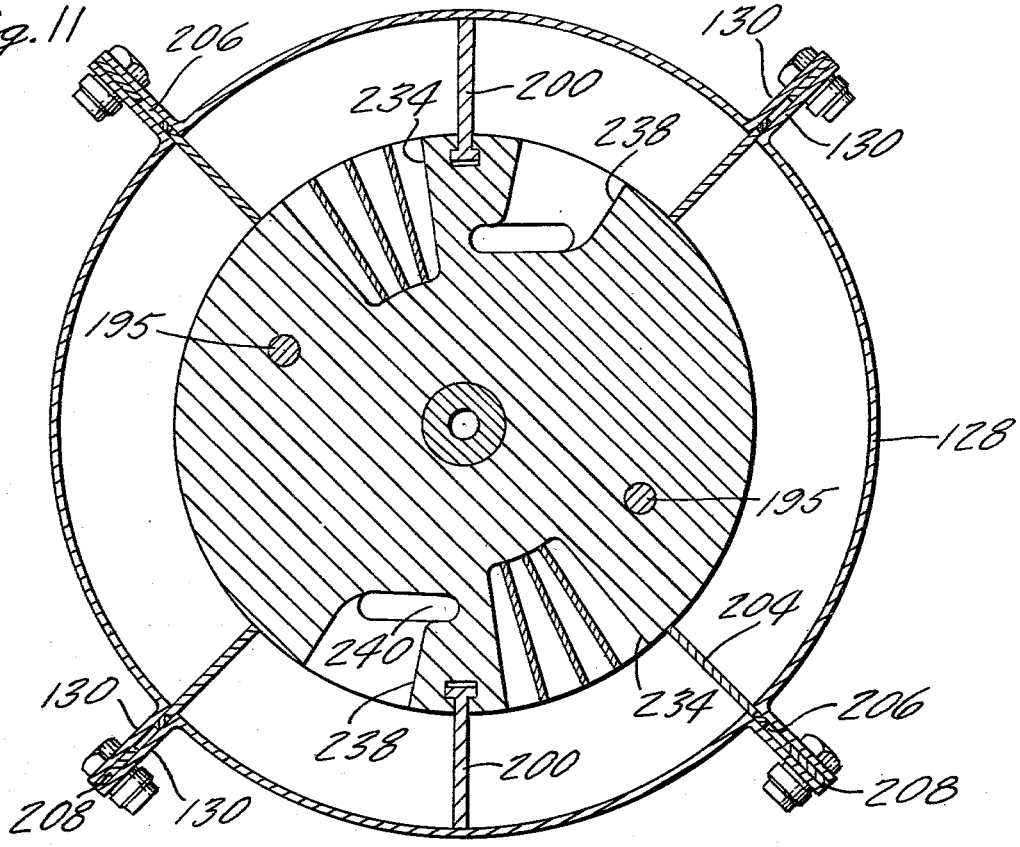
FIG. 11 is a transverse sectional view along line 11—11 of FIG. 9 through the low pressure pump.
Figure 13:
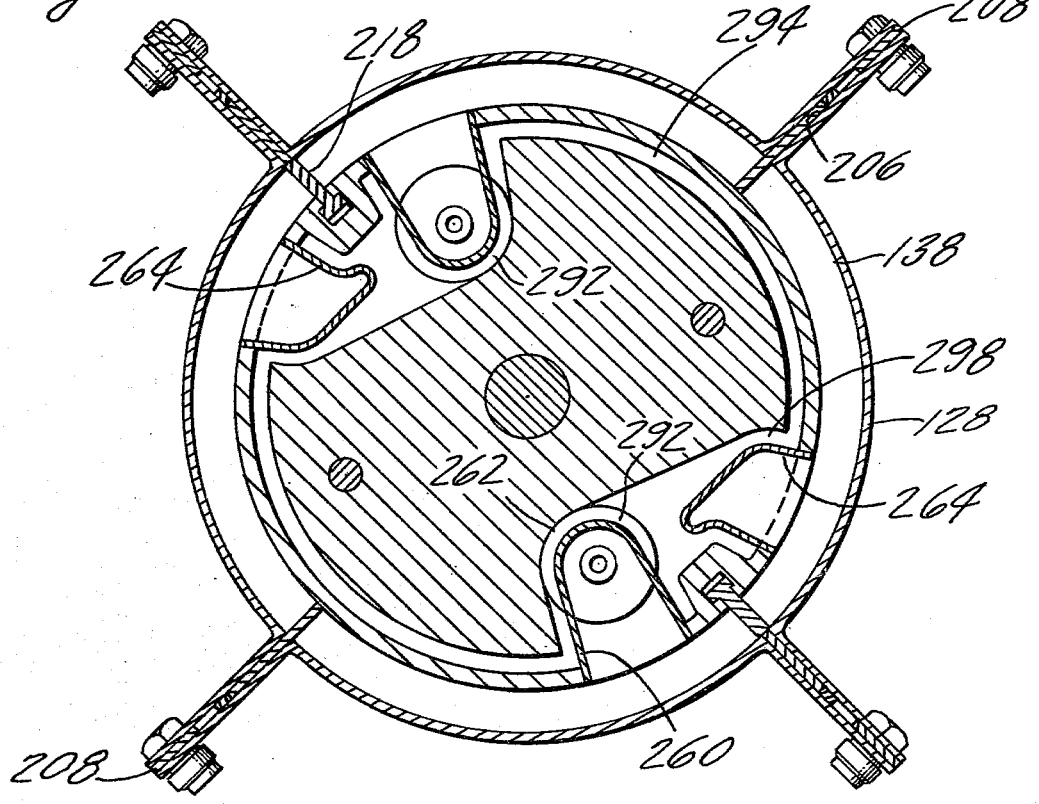
FIG. 13 is a transverse sectional view along line 13—13 of FIG. 9 through the high pressure motor.
Figure 15:
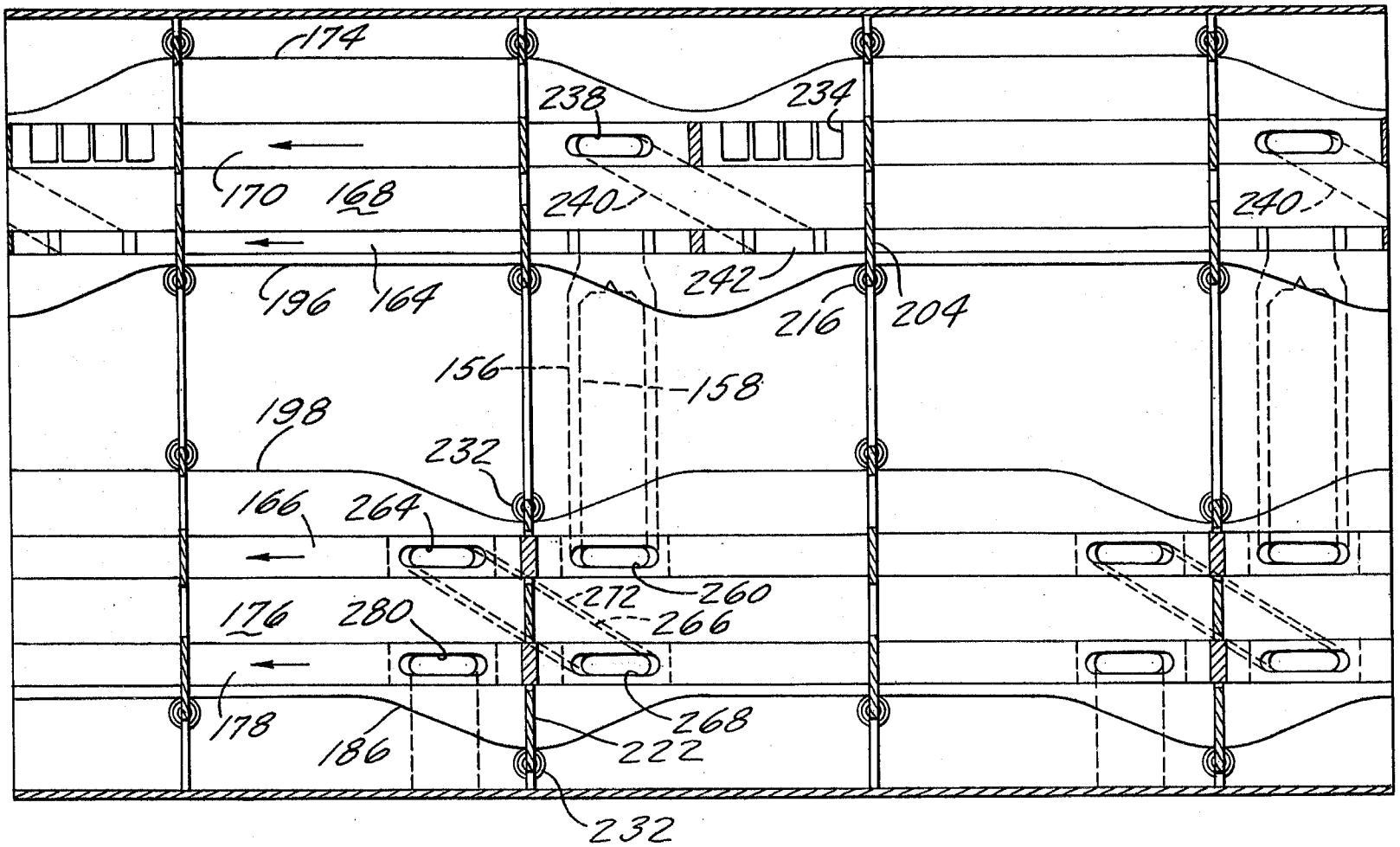
FIG. 15 is a developed view through the fluid annulus showing the functioning of the engine.

From this fluid path, outlet passages 238 in disc 170 guide the air radially inwardly in the disc and thence into passages 240 in the spacer 168. These passages 240 extend both axially and also circumferentially as shown in FIG. 15 to connect with the inlet passage 242 in the high pressure pump disc 164. This passage may be the full thickness of the disc with part of the passage walls defined by the spacer 168 and the end of the drum. Both inlet passages 234 and 242 are in axial alignment as shown in FIGS. 10 and 13 and are behind the associated pistons when viewed with respect to the direction of rotation. Since there are two pistons on each disc there are also two inlet passages in each disc as shown, these passages being diametrically opposed as are the pistons.

The high pressure pump disc also has an exhaust or discharge passage 244 with a construction similar to that of passage 242 for guiding the air from the fluid passage in the annular ring 136 into the axial passage 156 in the drum. In this passage fuel is introduced for combustion with the compressed air from passage 244. This fuel is introduced from a supply pipe 246 through a duct 248 in the end cap 122 and a transfer gland 250 to a radial passage 252 and an axial bore 254 in the shaft 148. From the bore 254 fuel flows through radial ducts 256 to a nozzle 258 at the upper end of each of the burner cans 158. The function of the burner structure is well known. Fuel burns therein and increases the energy content in the air from the pumps.

This high energy gas from the burner is directed through a duct 260 in the disc 166 into the fluid passage in the ring 138. This duct is spaced from the walls of a surrounding passage 262 in the disc 166. The hot gas entering this annular path functions as above described to impart rotation to the rotor to drive the engine. The disc 166 also has a discharge duct 264, FIG. 9, communicating with a duct 266 in the spacer 176 and thence to an inlet duct 268 in the disc 178, this duct 268 delivering the power fluid (heated air) into the annular space within ring 140. These ducts are located within and spaced from the surrounding passages 262 in disc 166, passage 272 in the spacer 176 and passage 274 in the disc 178. The purpose of these spaces around the ducts is to provide for a flow of cooling air from the space around the burner can 158 through these cooling spaces as will be described.

The disc 178 also has an outlet duct 280 located within and spaced from a passage 282 in disc 178 and duct 280 merges with another duct 284 in the projection 188 on the ring 180. This duct is within and spaced from the surrounding passage 189 which terminates in an annular groove 288 in the projection 188 and in alignment with the exhaust port 144. Within the groove 288 is a shield 290 that defines within it an annular path for the exhaust gas from duct 284 to the exhaust port 144. The projection 188 carries ring seals 291 at its outer end on opposite sides of the groove 288 and engaging the inner wall of the end caps 124 to prevent leakage of this exhaust gas into the casing.

Figure 9:
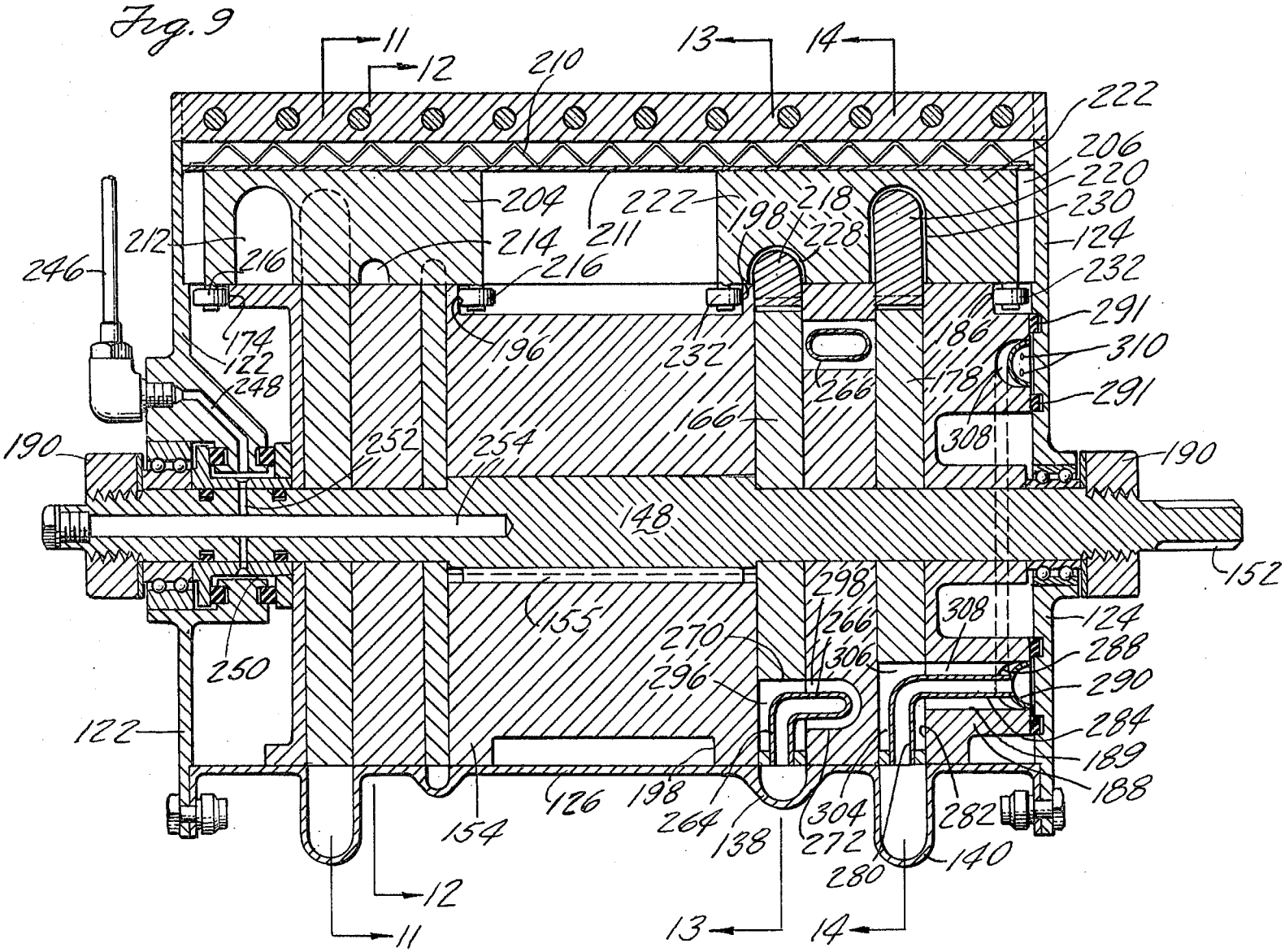
FIG. 9 is a sectional view along line 9—9 of FIG. 7.
Figure 14:
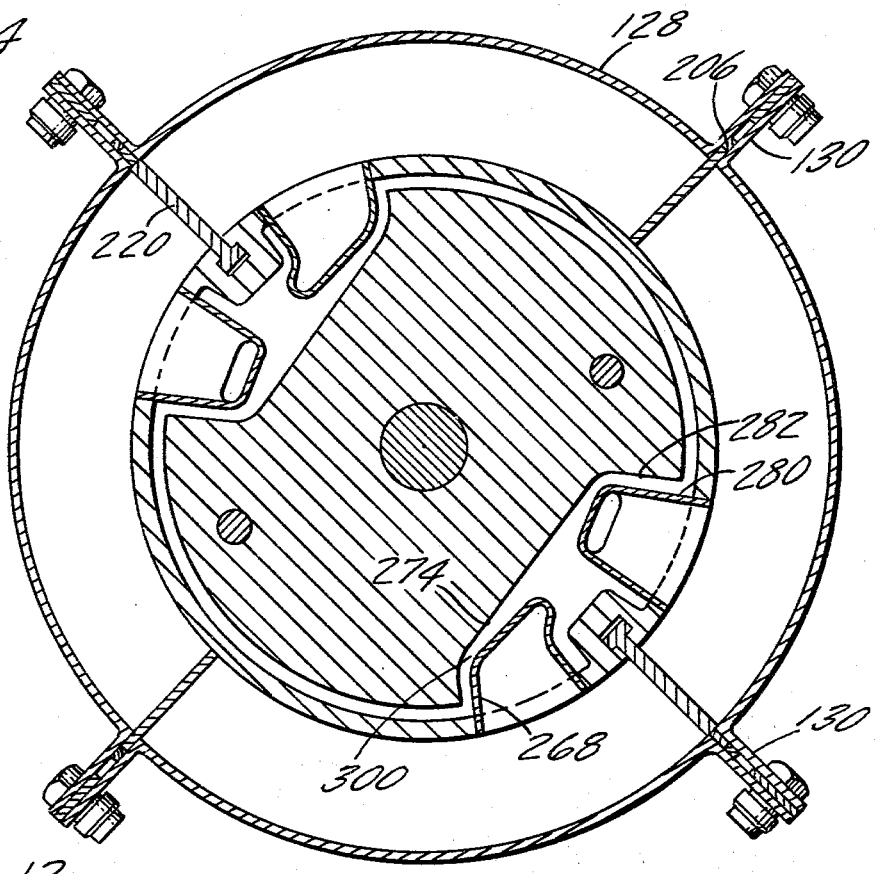
FIG. 14 is a transverse sectional view along line 14—14 of FIG. 9 through the low pressure motor.
Figure 12:
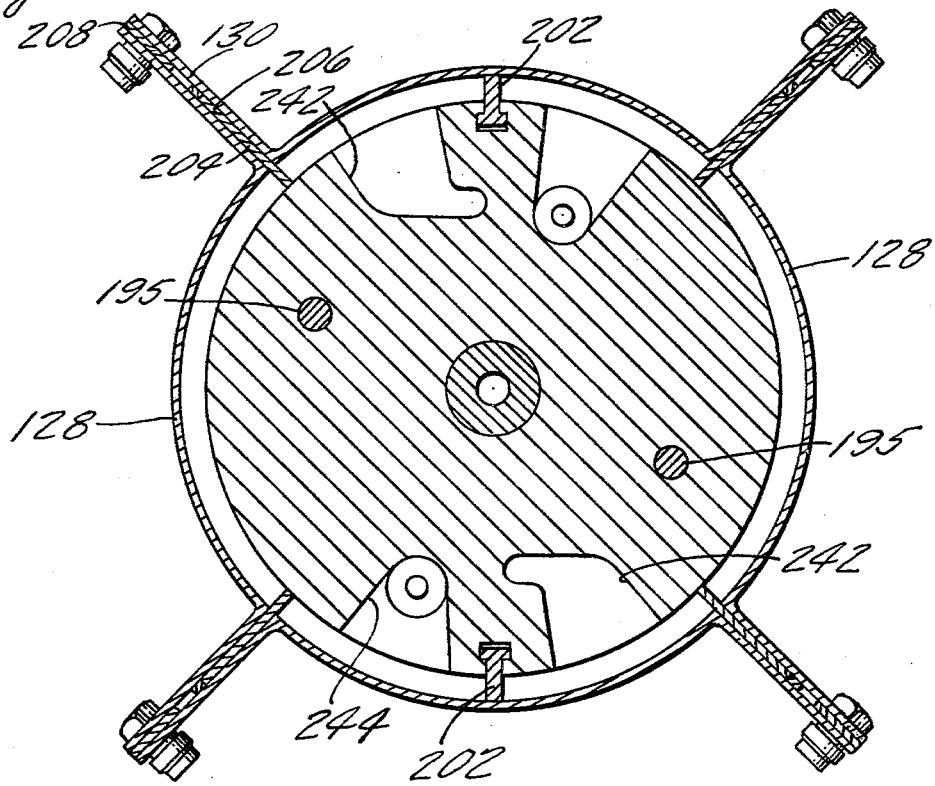
FIG. 12 is a transverse sectional view along line 12—12 of FIG. 9 through the high pressure pump.

Air for the cooling spaces in the hot gas motors is taken from the space around the burner can and enters space 292 surrounding duct 260. This space is in communication with a circumferential passage 294 in the disc 166 near its periphery for circulation of cooling air through this passage. Space 292 is also connected within the disc to the space 296 around discharge duct 266 as shown in FIG. 13. Space 296 communicates as shown in FIG. 9 with the space 298 surrounding connecting duct 266 in the spacer 176 and in turn is connected to the space 300 surrounding duct 268 in the low pressure disc 178. A circumferential passage 302 in the disc 178 near its periphery receives cooling air from space 300 with which it communicates. The space 304 around discharge duct 280 also communicates with space 300 as shown in FIG. 14. From space 304 cooling air reaches the space 306 around discharge duct 284 and into the space 308 around the shield 290. From space 308 cooling air flows through bleed holes 310 in the shield 290 to mix with the exhaust gas.

Although only one flow path through the engine has been described it will be apparent from FIG. 15 that there are two sets of these ducts diametrically opposed to each other as shown in FIGS. 11 to 14 inclusive as well as two combustion chambers. Each set of ducts or flow paths is carried through four complete cycles during each rotation of the rotor since there are four sets of valves around the axis of the engine.

The operation of the engine is believed to be clear from the foregoing description. Air enters the engine and is compressed as it passes through the first pump acting as a high volume compressor. From this pump the compressed air is directed through the rotor to the second stage or high pressure pump where it is further compressed before it is discharged into the burner devices. The displacement volume of the high pressure pump is smaller than the low pressure pump because of the smaller volume of air entering the second pump to assure the compression of the air to the design pressure for entry into the burner. Since the output of the first stage compressor is constant per cycle, the small or second stage compressor will accept the full output of the first stage pump only when design pressure has been attained.

In the burners energy is added by the combustion of fuel and the hot gas from the burner cans enters the first stage or high pressure motor. The displacement volume of this motor is matched to the output of the second stage or high pressure compressor to provide a suitably small pressure drop to maintain complete combustion within the burner while maintaining design burner pressure. This action necessitates partial expansion of the hot gas in the first motor in order to drive the rotor. The design goal is to provide maximum burner pressure with a maximum displacement volume difference between the high pressure compressor and the first motor consistent with the needs of fuel combustion and cooling air.

After partial expansion in the first motor the hot gas is ducted to the second or low pressure motor to provide, by expansion therein, additional energy from driving the engine rotor and for excess power for external use. In this motor the hot gas is expanded nearly to ambient pressure and is exhausted to atmosphere.

Although not shown, suitable means are provided for spinning the rotor for the purpose of starting the engine; and an igniter, also not shown, may be provided in the burner structure for igniting the fuel and air mixture therein when starting the engine. Such devices are conventional and need no further description.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of my invention, that which I claim as new and desire to secure by Letters Patent of the United States is:

1. A rotary device constituting a pump or motor and including:

a casing having an annular groove on its inner surface forming a gas path;

end caps on the casing having inlet and outlet openings, one in each cap;

a rotor within the casing and journalled in the caps and having a projecting piston thereon to fit within the annular groove and to move therein as the rotor turns; said rotor being shorter than the casing to define inlet and outlet chambers at opposite ends of the rotor;

said rotor having inlet and outlet passages therein, each passage extending from one end wall of the rotor and terminating in the periphery of the rotor to communicate with said groove, said inlet and outlet passages being adjacent to and on opposite sides of the piston; and connecting with said inlet and outlet chambers;

at least two valves axially movable in the casing and positioned to extend across and close said annular groove, each of said valves having an opening therein comparable in dimension to the piston for the piston to pass therethrough; and each valve having axially spaced inwardly extending projections located in said chambers; and cam means on each end of the rotor adjacent the projections and acting on the projections to move the valves axially to align the opening therein with the annular groove as the piston approaches the valves and to close the groove after the piston passes the valves; said cam means being located in said chambers.

2. A device as in claim 1 in which the casing is split axially to form segments with the valves positioned between the adjacent ends of the segments and spring means also between the segments and engaging said valves to urge them radially into engagement with the rotor.

3. A device as in claim 1 in which the cam means are located adjacent to the rotor periphery and engage directly with rollers on the projections.

4. A device as in claim 1 in which the valves are flat and lie in diametral planes in the casing and spring means urge the valves radially toward the periphery of the rotor.

5. A device as in claim 1 in which the rotor is made up of a central disc carrying the piston, a shaft on which the disc is mounted and spacer rings on the shaft on opposite sides of the disc, each spacer ring carrying a cam means for the valve.

6. A rotary gas engine including:

a casing having a plurality of axially spaced annular grooves in the inner surface;

a rotor within the casing;

a plurality of axially spaced pistons on the periphery of the rotor to fit within the annular grooves, there being at least one piston for each groove;

a drum element in the rotor and having at least one axial passage therein to form a combustion chamber;

said rotor having inlet and outlet passages therein, one pair of passages for each piston, for the flow of gas into and out of each annular groove and from one groove to the next, the combustion chamber forming a part of the passage from one of the grooves to the next;

means for supplying fuel to the combustion chamber through the rotor;

valves in the casing in a position to close the annular grooves in order to obtain the pump or motor action during operation, each valve having a passage therein for alignment with the associated groove as the piston moves past the valve; and cam means on the rotor for moving the valves during operation.

7. An engine as in claim 6 in which at least two of the annular grooves and cooperating pistons on the rotor act as a pump to compress air before it enters the combustion chamber and two others of the annular grooves and cooperating pistons, downstream of the combustion chambers act as a motor to drive the rotor and thus drive the pump.

8. An engine as in claim 6 in which each groove receives at least two pistons and each groove has at least four valves therein.

9. An engine as in claim 6 in which there are at least two annular grooves and cooperating pistons operating in series for successive compression of air for the combustion chamber, and at least two other annular grooves and cooperating pistons operating in series downstream of the combustion chamber to function as motors for driving the rotor.

10. An engine as in claim 6 in which the casing is segmental, having four segments with the valves located between adjacent segments.

11. An engine as in claim 6 in which the casing also has end caps secured to the segments and providing bearings for the rotor.

12. An engine as in claim 6 in which the rotor includes successive discs, each carrying at least one piston on the periphery to cooperate with one of the grooves in the casing, and spacers between successive discs, said spacers having passages connecting the outlet passage in one disc to the inlet passage of the next.

13. An engine as in claim 6 in which the combustion chamber has a burner can therein spaced from the chamber walls and into which the fuel is introduced.

14. An engine as in claim 13 in which the passages in the rotor downstream of the combustion chamber have ducts therein spaced from the walls of the passage, with these ducts connected to the downstream end of the burner can to receive hot gas from the burner can within the shield and with cooler air from the space around the burner can directed into the spaces around the ducts.

15. A rotary hot air engine including:

a rotor having at least two axially spaced pistons projecting from the periphery adjacent one end of the rotor, and at least two other axially spaced pistons projecting from the periphery adjacent the other end, said rotor also having a centrally located drum between the sets of pistons and having an axial passage therein to form a combustion chamber;

an annular casing surrounding the rotor and having axially spaced annular grooves in its inner surface, one for each piston which is movable therein as the rotor turns, the pistons and cooperating grooves at one side of the drum acting as pump devices and the pistons and cooperating grooves at the other side of the drum acting as motor devices, said casing having end caps with bearings for the rotor;

axially movable valves in the casing engaging with the periphery of the rotor and closing each groove, each valve having openings therein for alignment with the groove as the piston in each groove passes the valve;

cam means on the rotor acting on the valves for moving the valves in synchronism with the rotation of the rotor; and flow passages in said rotor providing for inlet and discharge of air from each annular groove on opposite sides of the piston, said rotor having connecting passages therein arranged so that the flow is in series in the pump device and from the device is directed to the combustion chamber in the drum, and with the flow from the chamber passing in series through the motor devices.

16. An engine as in claim 15 with the cam means at the periphery of the rotor and directly engaging the valves.

17. An engine as in claim 15 with the combustion chamber having a burner can therein and means for introducing fuel through the rotor to the burner can.

18. An engine as in claim 17 in which the passages in the motor devices have ducts therein spaced from the walls of the passage, with the ducts connected to receive hot gas from the burner can and with the cooler air from around the can entering and flowing through the space between the ducts and the passage walls.

19. An engine as in claim 15 in which each groove receives two pistons located diametrically opposite to each other on the rotor, and the casing has four circumferentially spaced valves cooperating therewith.

20. An engine as in claim 15 in which the second pump device in the direction of air flow through the rotor is smaller than the first, and the first motor device is smaller than the second.

21. An engine as in claim 15 in which the rotor has a disc in alignment with each groove for carrying the pistons associated with the aligned grooves, and with spacers in the rotor holding the discs in spaced relation, said discs having the inlet and discharge passages for each groove and said spacer having connecting passages for the inlet and discharge passages in the discs.

* * * * *